United States Patent [19]

Olthoff

[11] Patent Number: 4,793,233

[45] Date of Patent: Dec. 27, 1988

[54] MECHANISM FOR CHANGING BRIDGE SUPPORT BETWEEN ALTERNATE MODES IN STRINGED MUSICAL INSTRUMENTS

[76] Inventor: Kenneth G. Olthoff, 4136 Hidden Brook Dr., Glen Burnie, Md. 21061

[21] Appl. No.: 117,750

[22] Filed: Nov. 6, 1987

[51] Int. Cl.[4] ..... G10D 3/00

[52] U.S. Cl. ..... 84/299

[58] Field of Search ..... 84/267, 291, 298, 299, 84/307

[56] References Cited

U.S. PATENT DOCUMENTS

| | | | |
|---|---|---|---|
| 897,964 | 9/1908 | De Julio | 84/298 |
| 1,010,240 | 11/1911 | Degulio | 84/307 X |
| 2,025,875 | 12/1935 | Loar | 84/307 X |
| 2,190,475 | 2/1940 | Gretsch, Jr. | 84/298 |
| 2,565,253 | 8/1951 | Melita | 84/298 |
| 2,786,382 | 3/1957 | Melita | 84/298 |
| 2,972,923 | 2/1961 | Fender | 84/307 X |
| 3,353,433 | 11/1967 | Webster | 84/299 X |
| 4,201,108 | 5/1980 | Bunker | 84/298 X |
| 4,253,371 | 3/1981 | Guice | 84/299 X |
| 4,334,454 | 6/1982 | Wall | 84/299 |
| 4,411,186 | 10/1983 | Faivre | 84/298 |
| 4,433,603 | 2/1984 | Siminoff | 84/267 |
| 4,573,391 | 3/1986 | White | 84/291 |

FOREIGN PATENT DOCUMENTS

| | | | |
|---|---|---|---|
| 1160081 | 1/1984 | Canada . | |
| 452570 | 8/1936 | United Kingdom | 84/299 |
| 942999 | 11/1963 | United Kingdom . | |

OTHER PUBLICATIONS

Tom Wheeler, "Rare Bird Vivi-Tone Electronics", Guitar Player, Jul. 1979, pp. 12, 174 and 176.

*Primary Examiner*—L. T. Hix
*Assistant Examiner*—Brian W. Brown
*Attorney, Agent, or Firm*—Laubscher & Laubscher

[57] ABSTRACT

A device for altering the coupling of the strings of a hollow-bodied stringed musical instrument includes a rigid member mounted within the instrument body and a mode changing mechanism for selectively connecting the bridge of the instrument with the rigid member or with the instrument soundboard. When connected with the rigid member, the bridge transfers acoustic energy from the instrument strings thereto to produce a solid body sound. When the bridge is connected with the soundboard, acoustic energy from the strings produces a hollow body sound.

13 Claims, 4 Drawing Sheets

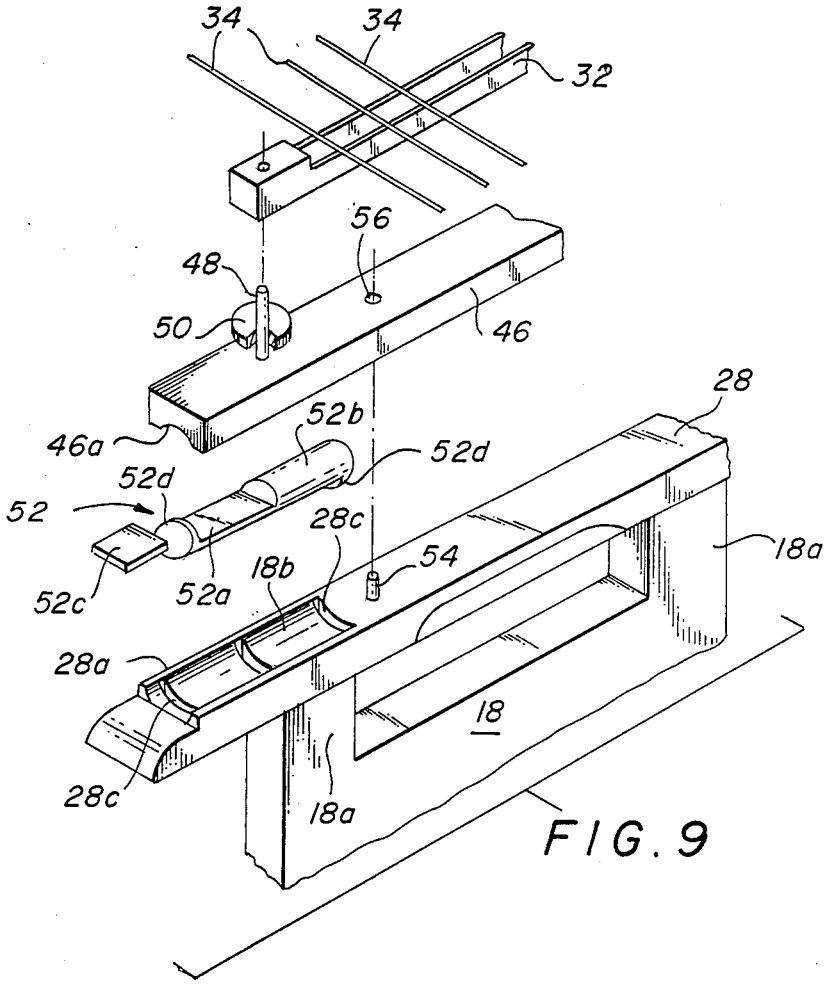
FIG. 9
FIG. 10
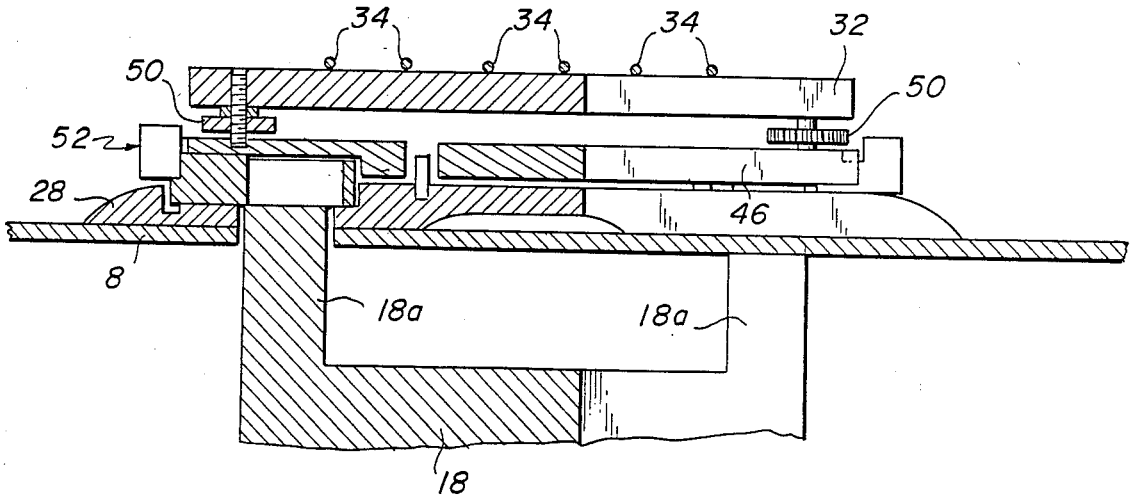

MECHANISM FOR CHANGING BRIDGE SUPPORT BETWEEN ALTERNATE MODES IN STRINGED MUSICAL INSTRUMENTS

BACKGROUND OF THE INVENTION

The present invention relates to a mechanism for increasing the versatility of stringed musical instruments, such as guitars and mandolins, equipped for electronic amplification by shifting the bridge support to alter the coupling of the instrument strings with the instrument soundboard to produce a hollow body sound, a solid body sound, or a combination of the two.

When a large amount of energy is transferred between the vibrating strings and the body of a stringed musical instrument, the instrument will produce a significant volume of sound without the use of amplification. A low amount of energy transfer will reduce the unamplified volume, but has the benefit of allowing the strings to vibrate for a significantly longer time after being plucked, due to the decrease in energy dissipated by vibration of the body of the instrument. This increased vibration time is commonly called sustain by musicians and is very desirable for some styles of music. Another concern of the musician relating to the vibrational traits of a stringed instrument used with an amplification system is the chance of acoustic feedback being generated during a performance. Acoustic feedback is produced when the sound produced by the instrument is amplified and the force of the sound from the amplifier is strong enough and in the right phase to cause the strings to vibrate more, making the sound louder. Thus, an instrument that vibrates less easily is less likely to fall victim to feedback. Accordingly, a rough rule of thumb is that resistance to feedback and sustain are inversely proportional to unamplified volume capability.

These different possible proportions of volume to sustain/feedback resistance are due to the motion of the strings being coupled to the soundboard of the instrument. As the soundboard flexes, the kinetic energy of the string is converted into sound and, to some extent, heat resulting from friction. As a general rule, the more vibration that is passed from the instrument strings to the soundboard, the greater the amount of motion in the soundboard. This results in more sound being produced, but it results in the kinetic energy of the string being used up more quickly.

Since the two factors involved have an inversely proportional relation, two theoretical extremes are possible. First, all of the kinetic energy of the strings could be converted instantaneously to sound. This would result in a very short but loud sound, after which the strings would be perfectly still. The other extreme would be for the energy of the strings to be dissipated only in the strings with no vibration at all in the soundboard. This would result in quiet sound that lasted for a longer time. It would be quiet because the string has far less surface area to transfer motion into sound and it would last longer because the energy would be converted at a slower rate.

In addition to the relationship between the sound produced by an instrument string and the duration of string vibration, one additional factor must be considered. A given area of vibrational surface will produce different amounts of sound depending on how easily it vibrates. In general, a rigid surface will not vibrate, but will instead reflect the vibration back into the strings while a springy surface will begin to vibrate with the string, thereby producing sound. When surface characteristics are taken into account, it can be seen that the performance of an instrument soundboard is dependent on both its area and vibrational characteristics. A solid body, however, is far less sensitive to changes in size so long as it maintains its rigidity. This is because the amount of vibration in a solid body per unit of area is so small that changing the area has little effect on the system. The size of a solid body tends to be significant only as it impacts rigidity and structural strength.

All three characteristics of instrument performance related to ease of vibration (unamplified volume on one side of the spectrum, increased sustain and feedback resistance on the other) are desirable qualities in an instrument. Due to the fact that they are somewhat inversely related, however, most instruments are designed to emphasize either unamplified volume or the combination of sustain and feedback resistance. The present invention seeks to provide a means for a single instrument t be switched between distinct modes of operation with each mode having a different combination of volume, tone and sustain characteristics.

BRIEF DESCRIPTION OF THE PRIOR ART

Currently available stringed musical instruments such as guitars can be categorized in accordance with the degree of acoustic energy transferred between the strings and the body of the instrument. At one extreme is the full depth hollow bodied guitar which is designed for maximum transfer of acoustic energy from the strings to the soundboard, with the acoustic qualities of the guitar body providing a major influence on the tonal quality of the amplified sound. At the opposite extreme is the solid body guitar, which is designed primarily for its amplified sound and sustain qualities, with the acoustic qualities of the body having comparatively little influence on the amplified sound. A variety of compromise designs exist in between the two extremes, including the thin hollow body (the body is hollow, but only 1.5" to 2.5" deep, as opposed to 3" to 5" for a "full depth" body) and semi-hollow body (usually the same depth as a "thin hollow body" but with a solid block of wood directly under the bridge connecting the top and back of the guitar body) as well as several variations which attempt to maximize all of the characteristics at once, in defiance of the laws of physics.

The result of all of this variety in guitar designs is that many musicians have reluctantly decided that in order to cover all styles of music well, they need to have both a hollow body and a solid body guitar, switching between the two when necessary.

Instruments have been built that allow the vibrational characteristics to be changed, but there have been limits to either the speed or amount of change possible, which restricted their practical utility in a performance setting.

Some prior patented designs, as evidenced by the U.S. Pat. No. 4,573,391, to White have taken the approach of providing a skeletal neck and body which can be played as an electric guitar, or, with the addition of a removable sound chamber, as an acoustic guitar. Similarly, the Siminoff U.S. Pat. No. 4,433,603 discloses an electric guitar composed of modular assemblies which could also conceivably be turned into a hollow body with different modular pieces. In each case, though, some degree of time would be required to perform the change, which would eliminate the possibility of conversion between hollow and solid body designs during a concert or other live performance.

Another prior design is evidenced by Lloyd Loar's VIVITONE electric guitar of the 1930's (U.S. Pat. No. 2,025,875) wherein a lever and fulcrum system are provided to adjust from pure acoustic to pure electric output, but with little emphasis on the vibration and sustain characteristics of the system in the electric mode, other than for suppression of feedback. The complexity of the design was also a drawback in that it required a screwdriver or wrench to change between modes. Furthermore, changing modes altered the height of the bridge, which would in many cases necessitate retuning.

At the time of his invention, the idea of a solid body electric guitar was unknown, and Mr. Loar's concern was more oriented toward changing between a purely acoustic (unamplified) mode and an electric mode (to allow amplification or broadcast of the performance). The electric mode was designed primarily to improve upon the relatively poor pickup and microphone technology that was the state of the art for the broadcast and recording industry at that time, rather than to exploit the unique characteristics of the electric guitar.

The present invention was developed in order to overcome these and other drawbacks of the prior devices by providing a performing musician with the means to easily switch between the performance characteristics of a full hollow body and those of a solid body in the same instrument quickly enough to allow the switch to be done during a live performance by the musician, thereby allowing the artist to utilize the different tonal and sustain qualities of the different modes.

SUMMARY OF THE INVENTION

Accordingly, it is a primary object of the present invention to provide a mechanism for manually altering the coupling of the strings of a hollow bodied stringed musical instrument with the instrument soundboard. A rigid member is mounted within the body of the instrument and includes a portion which extends through the instrument soundboard. A fixed bridge base is connected with the soundboard and a bridge saddle is provided for supporting the instrument strings. A shift mechanism selectively connects the bridge saddle with the bridge base and soundboard or with the rigid member, or with both the bridge base and rigid member to alter the coupling of acoustic energy from the instrument strings. More particularly, when the bridge saddle is connected solely with the bridge base, acoustic energy is coupled to the soundboard to produce a hollow body sound. When the bridge saddle is connected with the rigid member, acoustic energy is coupled to and reflected by the member to produce a solid body sound. Finally, when the bridge saddle is connected with both the bridge base and the rigid member, acoustic energy is coupled to both the soundboard and the rigid member to produce a partial solid body sound.

According to another object of the invention, the shift mechanism comprises a pair of independently operable adjustable connecting devices arranged at opposite ends of the bridge saddle.

According to a further object of the invention, the adjustable connecting devices each comprise a geared mechanism, a rotary cylinder, or a slide mechanism.

It is a further object of the invention to provide means for adjusting the height of the bridge saddle relative to the bridge base.

BRIEF DESCRIPTION OF THE FIGURES

Other objects and advantages of the subject invention will become apparent from a study of the following specification when viewed in the light of the accompanying drawing, in which:

FIG. 9 is an exploded partial perspective view of a second embodiment of a bridge support altering device including a rotating cylinder according to the invention;

FIG. 10 is an end sectional view of the device of FIG. 9 in its assembled condition;

DETAILED DESCRIPTION

Figure 1:
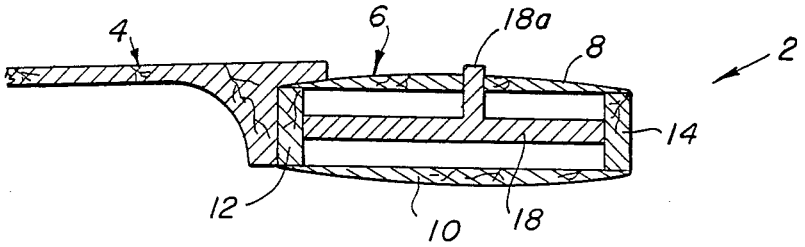
FIGS. 1–4 are side sectional views of a guitar body illustrating alternate mounting configurations for the rigid member.

Referring first to FIGS. 1–5, there is shown a hollow body guitar 2 including a neck portion 4 and a body portion 6 including a top soundboard 8, a back wall 10, headblock 12 and tailblock 14 sections, and side wall sections 16. Within the hollow body portion 6 of the guitar is mounted a rigid solid member 18 formed of a lightweight metal, wood, or other rigid material. At least a portion **18*a* of the rigid member extends upwardly through an opening in the soundboard 8**.

Figure 2:
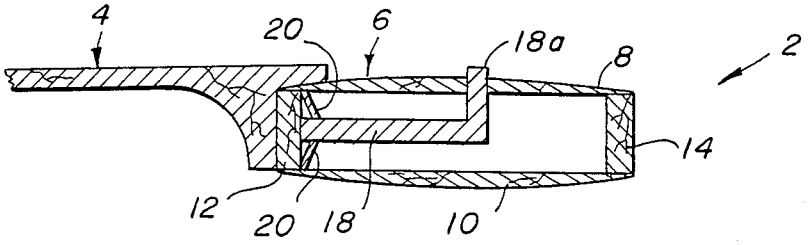
Figure 3:
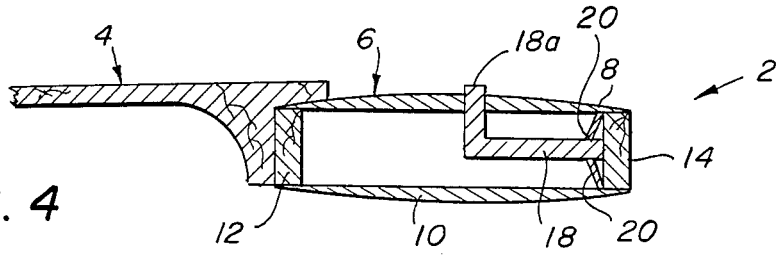

In the embodiment of FIG. 1, the rigid member is secured to the headblock 12 and tailblock 14 portions of the instrument body portion by any suitable means such as an adhesive, screws, nails, or the like. In the embodiment of FIG. 2, the rigid member is secured only to the headblock portion 12 and in the embodiment of FIG. 3, the member is secured only to the tailblock portion 14. Braces 20 are provided between the member and the headblock and tailblock portions of the embodiments of FIGS. 2 and 3, respectively, to further support the member.

The present invention is based upon a manually operated mechanical structure allowing the saddle portion of the instrument's string supporting bridge 22 (FIG. 5) to be physically supported by either a bridge base connected with the soundboard 8 or by the rigid member 18 internally arranged in the hollow guitar body which serves as an analog to a solid guitar body.

The preferred form of the rigid member is as a solid link between the headblock 12 and a tailblock 14 portions of the guitar body with no direct contact with the sides, bottom, or soundboard of the instrument as shown in FIG. 1. With the rigid member attached only to the head and tailblocks, maximum isolation is achieved between the member 18 and the portions of the instrument body which dissipate the majority of the acoustical energy in the instrument. This serves to maximize the performance differences between the hollow and solid modes of the instrument.

Figure 4:
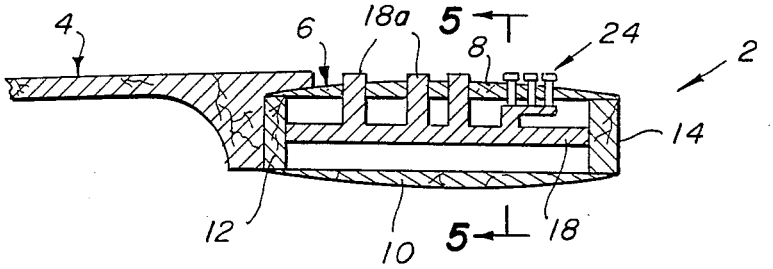
Figure 5:
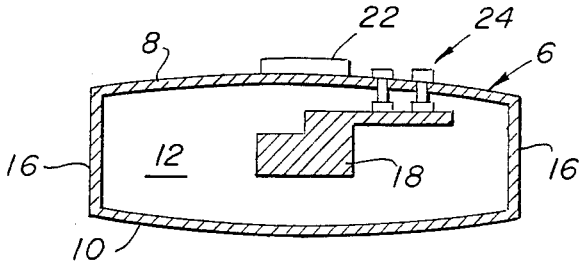
FIG. 5 is a sectional view of a guitar body taken along line 5—5 of FIG. 4.

With the rigid member mounting arrangement of FIGS. 4 and 5, isolation of the pickups and controls 24 can be achieved by mounting them directly on the rigid member and allowing them to protrude through appropriate openings in the soundboard 8. This allows the soundboard to be optimized for acoustic performance without the added mass of the electronics.

While the rigid member is not normally found in conventional instruments, it may easily be installed by a competent luthier, thus allowing retrofitting of a performer's current instrument if so desired. An instrument being built to utilize the present invention could be designed with the neck, headblock, rigid member, and tailblock constructed as a unit. The soundboard, sides, and bottom of the acoustic chamber would then be assembled around the unit to complete the body of the guitar. This type of construction is well suited to mass production.

Figure 6:
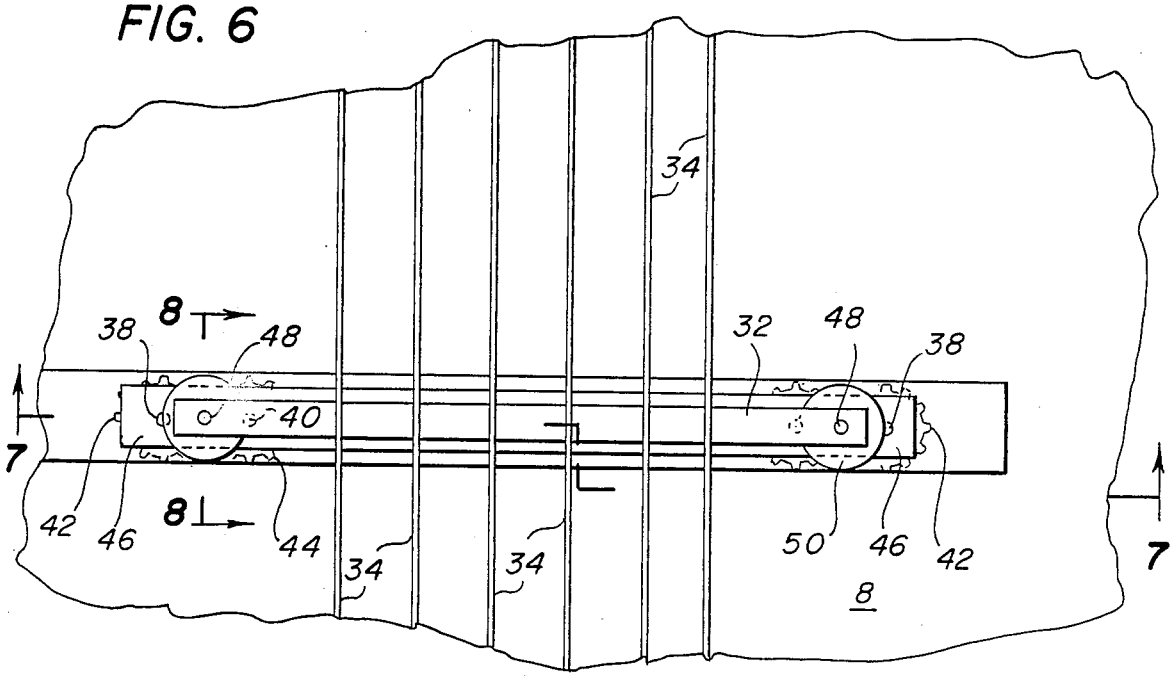
FIG. 6 is a top plan view of a first embodiment of a bridge support altering device including an adjustable gear mechanism according to the invention.
Figure 7:
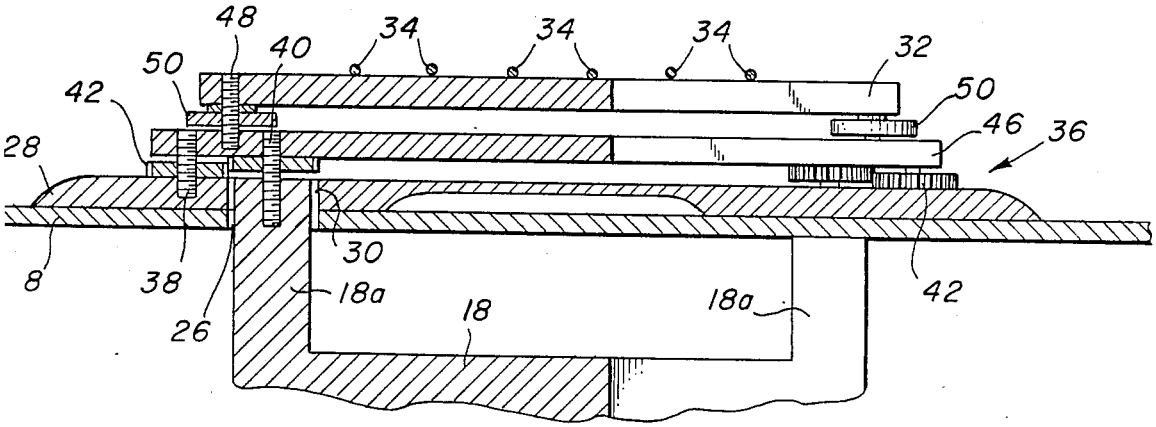
FIGS. 7 and 8 are sectional views of the device of FIG. 6 taken along lines 7—7 and 8—8 thereof, respectively.
Figure 8:
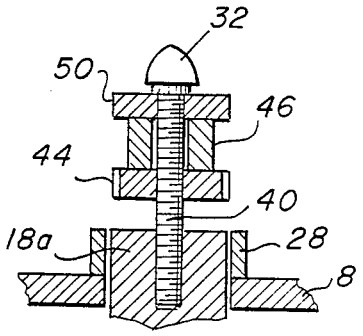

Referring now to FIGS. 6–8, a first embodiment of a bridge support shifting mechanism according to the invention is shown. The instrument soundboard 8 contains a pair of lateral openings 26 (of which only one is shown) for receiving a pair of extensions 18*a* from the rigid member 18 and providing isolation between the soundboard and rigid member. A transverse bridge base 28 is connected with the soundboard and also contains a pair of openings 30 (of which only one is shown) aligned with the soundboard openings for receiving and isolating the rigid member extensions 18*a*. A transverse bridge saddle 32 is arranged above the bridge base and supports the strings 34 of the instrument.

An adjustable gear mechanism generally indicated as 36 is provided for selectively connecting the bridge saddle with the bridge base 28, with the rigid member 18, or with a combination of the two. The adjustable mechanism includes a pair of geared assemblies arranged at opposite ends of the bridge saddle. Each mechanism includes a first threaded spindle 38 connected with the bridge base 28 and a second threaded spindle 40 connected with the rigid member extension portion 18*a* as shown in FIG. 7. A first gear 42 is threadably connected with the first spindle 38 and a second gear 44 is threadably connected with the second spindle 40. The gears are meshed together whereby when the first or outer gear 42 is rotated in one direction, the second or inner gear 44 is rotated in the opposite direction. This results in vertical displacement of the first gear 42 up or down the spindle 38 while the second gear 44 is moved in the opposite direction on the spindle 40. At least one of the gears 42, 44 supports a crosspiece 46 which in turn supports the bridge saddle 32 as will be developed below. By controlling the positioning of the gears 42, 44, the crosspiece, and thus the bridge saddle may be connected either with the soundboard via the gear 42, spindle 38, and bridge base 28, or with the rigid member via the gear 44 and spindle 40, or with both the soundboard and rigid member when the gears 42 and 44 are at the same level and both support the bridge crosspiece. The crosspiece 46 contains openings for receiving the tops of the spindles 38, 40, whereby the crosspiece is free floating movement relative to the spindles.

Extending upwardly from opposite ends of the crosspiece 46 are a pair of third threaded spindles 48 having thumbwheels 50 threadably connected thereon which support the bridge saddle 32. The bridge saddle contains a pair of openings for receiving the upper ends of the spindles 48 whereby the bridge saddle is free-floating relative to the crosspiece. Rotation of the thumbwheels 50 vertically displaces the bridge saddle to provide height adjustment thereof.

It will be readily apparent that acoustic coupling of the energy generated by the instrument strings 34 is provided through the bridge saddle 32, the thumbwheels 50, and the spindles 48 to the crosspiece 46. Selective operation of the gears 42, 44 determines the acoustic coupling of the energy to the soundboard 8, the rigid member 18, or to a combination of the two. With the first gears 42 in their upper position supporting the crosspiece, the second gears 44 are in their lower position out of contact with the crosspiece. Acoustic energy is thereby transferred from the crosspiece to the first gears 42, the first spindles 38, the bridge base 28 and the soundboard 8 to produce a full hollow bodied sound. Conversely, with the first gears 42 in their lower position and the second gears 44 in their upper position (as shown in FIG. 7), acoustic energy is coupled from the crosspiece to the second gear 44, the second spindles 40, and to the rigid member extension portion 18*a* which reflects the energy to produce a solid body sound. Finally, with both gears at an intermediate position with each supporting the crosspiece, acoustic energy is transferred to both the soundboard and the rigid member to produce an intermediate sound which is partially hollow body and partially full body.

A second embodiment of the bridge support shifting mechanism is shown in FIGS. 9 and 10 wherein like parts are designated by the same reference numerals as in the embodiment of FIGS. 6–8. Essentially, the adjustable gear mechanism is replaced by a rotary cylinder 52 arranged between the crosspiece 46 and the bridge base 28 and the rigid member extension portions 18*a*. Each end of the bridge base 28 includes a concave recess 28*a* in the top surface thereof, and the top surfaces of the rigid member extension portions also contain concave recesses 18*b*. Each end of the crosspiece 46 contains a concave recess 46*a* in the bottom surface thereof opposite the recesses 28*a* and 18*b* to define a cylindrical chamber for receiving the rotary cylinder 52.

As best shown in FIG. 9, the rotary cylinder includes two hemi-cylindrical portions 52*a*, 52*b* on opposite sides thereof, and a lever portion 52*c* which extends exteriorly of the chamber. One hemi-cylindrical portion 52*a* of the cylinder is aligned with the bridge base recess 28*a* while the other hemi-cylindrical portion is aligned with the rigid member extension recess 18*b*. Rotation of the cylinder 52 about its axis by the lever 52*c* determines which of the bearing hemi-cylindrical surfaces supports the cross piece and which of the bearing hemi-cylindrical surfaces is in contact with either the bridge base or the rigid member extension, thereby selecting the mode of acoustic coupling for hollow body or full body sound. Annular end portions 52*d* are provided to stabilize the cylinder 52, with grooves 28*c* being provided in the bridge base 28 for receiving the annular end portions. The cylinder may also be positioned whereby both hemi-cylindrical surfaces support the crosspiece and engage the bridge base and rigid member extension, respectively, as shown in FIG. 10, to produce a partial solid body sound.

Since the crosspiece 46 may tend to rock forwardly or rearwardly on the cylinder 52, a guide pin 54 is provided on the bridge base 28 for a loose fit within an opening 56 in the crosspiece for stabilization. The loose fit prevents significant vibration transfer by way of the guide pin while preventing undesired rotation of the crosspiece 46 and bridge saddle 32 around the cylinder axis. As in the embodiment of FIGS. 6–8, height adjustment is provided by supporting the bridge saddle 32 on thumbwheels 50 which are vertically movable on the threaded shafts 48 mounted on the crosspiece 46.

The rotary cylinder configuration is an improvement over the gear mechanism of FIGS. 6–8 in that better isolation is provided between coupling modes. With the meshed gears, some acoustic energy is always transferred therebetween. Moreover with the gear mechanism, the threads of the first and second spindles 38, 40 must be sufficiently fine to prevent the instrument from going out of tune due to vertical movement of the bridge.

Figure 11:
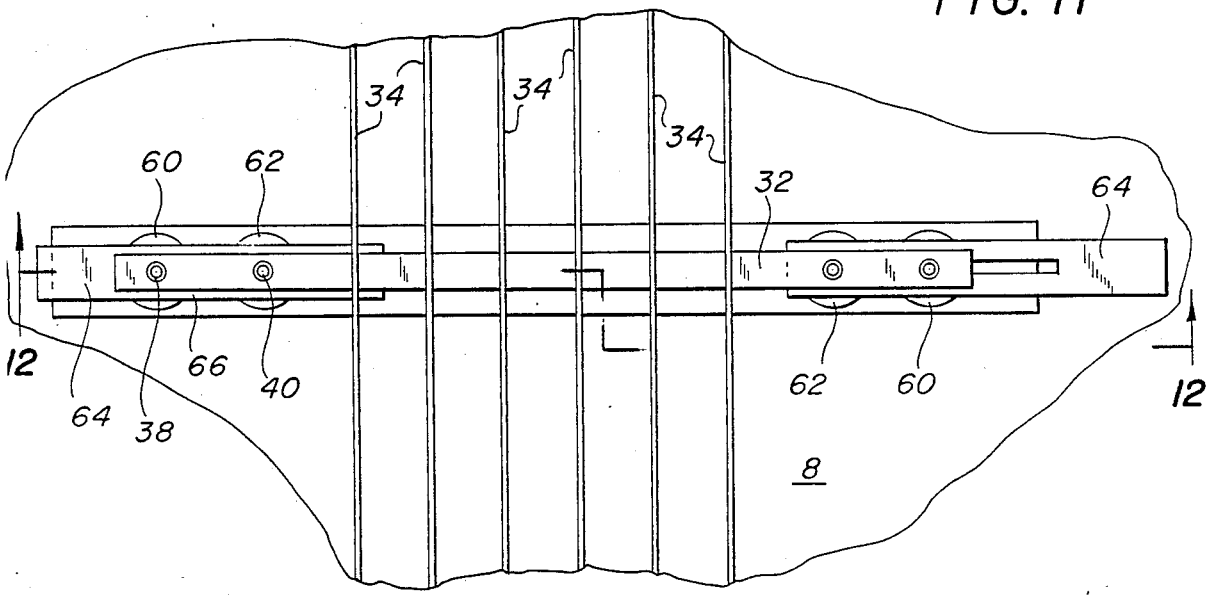
FIG. 11 is a top plan view of a third embodiment of a bridge support altering device including a slide mechanism according to the invention.
Figure 12:
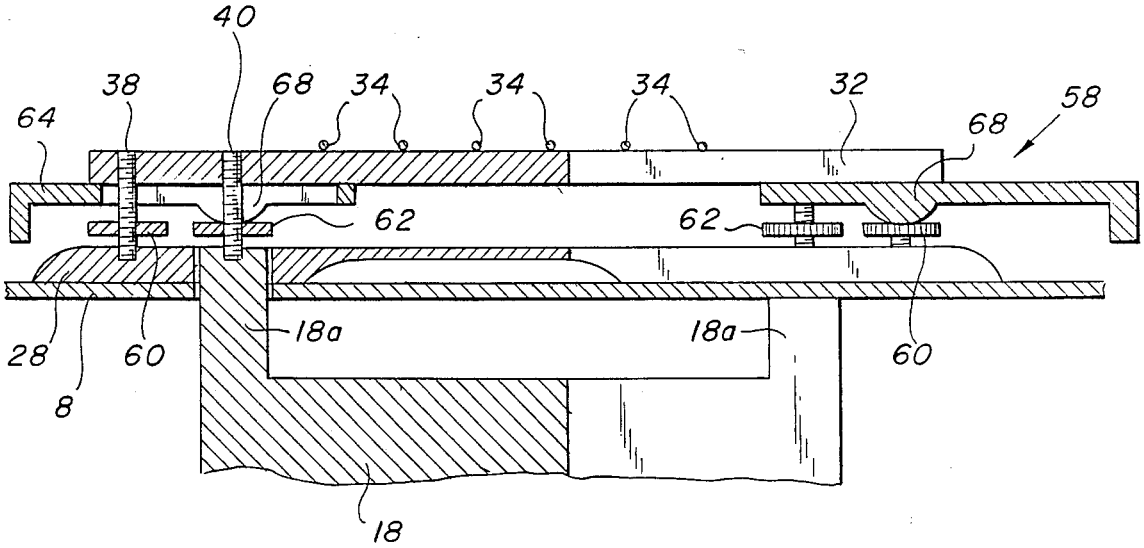
FIG. 12 is a sectional view of the device of FIG. 11 taken along line 12—12 thereof.

A third embodiment of the bridge support shifting mechanism is shown in FIGS. 11 and 12. In this embodiment, a slide device 58 provides the control mechanism for shifting between modes of operation of the bridge. As in the embodiment of FIGS. 6–8, first and second spindles 38, 40 are connected with the bridge base 28 and rigid member extension 18*a*, respectively. The spindle includes first and second thumbwheels 60, 62 which are not meshed as in the first embodiment. Each slide member 64 contains an elongated opening 66 through which the spindles freely pass. Adjacent the opening, the slide member includes a protrusion 68 adapted to rest on one or both of the thumbwheels 60, 62 depending on the selected lateral position of the slide member. The upper portion of the slide members supports the bridge saddle at opposite ends as shown in FIG. 12, although a single slide could be provided extending continuously beneath the bridge saddle, where independent operation of the slides is not required. The bridge saddle contains openings to freely receive the upper ends of the first and second spindles.

With the slides 64 shifted inwardly as shown by the left slide in FIG. 12, acoustic energy is coupled from the bridge saddle 32 to the slide 64, to the thumbwheels 62, to the spindles 40, and into the rigid member extension 18*a* to produce a solid body sound. Shifting of the slides outwardly as shown by the right slide in FIG. 12 couples energy from the slides to the thumbwheels 60, spindles 38, bridge base 28 and soundboard 8 to produce a hollow body sound. Thus, the slides may both be positioned inwardly for full coupling with the rigid member, outwardly for full coupling with the soundboard, or intermediately for contact of the protrusion 68 with both thumbwheels 60, 62 and thus with the rigid member and the soundboard producing partial solid body sound.

Height adjustment of the bridge saddle is provided by vertical displacement of the thumbwheels 60, 62.

The various embodiments discussed above all provide a number of benefits of the mode changing system of the present invention. The system allows independent adjustment of either end of the bridge saddle, thereby providing the performer with a new range of options in addition to full hollow or full solid body modes, such as for example, having the bass end of the bridge in solid body mode and the treble end of the bridge in hollow body mode. The system provides an intermediate setting where support is shared between the soundboard and rigid member to provide semi-hollow or semi-solid sound. Shifting of the bridge between modes can be accomplished quickly without using any tools. Height or intonation adjustments are provided and switching between modes does not require retuning of the instrument. Finally, the internal rigid member is designed so as not to interfere with the vibration of the top, back, or sides of the instrument.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. Apparatus for altering the bridge support for different modes of operation of a hollow body stringed musical instrument having a soundboard, comprising (a) bridge saddle means for supporting the strings of the instrument and for coupling the acoustic energy generated thereby;

(b) a rigid member mounted within the body of the instrument; and (c) means for selectively connecting said bridge saddle means with said rigid member and with the instrument soundboard to alter the acoustical sound produced by the instrument, whereby when said bridge saddle means is connected with the soundboard, acoustic energy from the instrument strings is coupled to the soundboard to produce a hollow body sound, and when said bridge saddle means is connected with said rigid member, acoustic energy from the instrument strings is coupled to and reflected by said rigid member to produce a solid body sound, and when said bridge saddle means is coupled with both the soundboard and said rigid member, acoustic energy from the instrument strings is coupled to the soundboard and said rigid member to produce a partial solid body sound.

2. Apparatus as defined in claim 1, wherein said connecting means includes a pair of adjustable connecting devices arranged at the opposite ends of said bridge saddle.

3. Apparatus as defined in claim 2, wherein said adjustable connecting devices are independently operable.

4. Apparatus as defined in claim 2, and further comprising means for adjusting the height of said bridge saddle means relative to said bridge base member.

5. Apparatus as defined in claim 4, wherein said height adjustment means comprise a pair of independently operable adjustment devices connected with the opposite ends of said bridge saddle means.

6. Apparatus as defined in claim 4, wherein said rigid member is connected with at least one of the headblock and tailblock portions of the instrument, whereby maximum isolation is achieved between the soundboard, side, and bottom portions of the instrument which dissipate the majority of the acoustical energy when said bridge saddle means is connected with the soundboard.

7. Apparatus as defined in claim 6, and further comprising a bridge base member connected with the soundboard and a crosspiece arranged between said bridge saddle means and said bridge base member, said bridge saddle height adjustment means being connected with said crosspiece.

8. Apparatus as defined in claim 7, wherein said adjustable connecting devices each comprise a geared mechanism for selectively coupling acoustic energy from the strings to the soundboard and the rigid member via said crosspiece.

9. Apparatus as defined in claim 8, wherein said crosspiece contains a pair of openings at each end thereof in alignment with said geared mechanisms, and further wherein each of said geared mechanisms includes (1) a first threaded member having one end connected with said bridge base member and another end extending into one of said crosspiece openings;

(2) a second threaded member having one end connected with the extended portion of said rigid member and another end extending into the other of said crosspiece openings; and (3) meshing gear means including a pair of gears connected with said first and second threaded members, respectively, for supporting said crosspiece, rotation of said gear means causing vertical displacement of said gears in opposite directions, whereby selective rotation of said gear means selectively positions said gears for selective coupling of acoustic energy.

10. Apparatus as defined in claim 7, wherein said adjustable connecting devices each comprise a rotatable cylindrical mechanism for selectively coupling acoustic energy from the strings to the soundboard and the rigid member via said crosspiece.

11. Apparatus as defined in claim 10, wherein (1) said bridge base member includes a concave recess and an adjacent opening for receiving the extended portion of said rigid member in each end thereof;

(2) said extended portion of said rigid member contains a concave recess;

(3) said crosspiece contains concave recesses at the opposite ends thereof opposite said bridge base member and rigid member concave recesses, the recesses defining cylindrical chambers; and further wherein (4) said cylindrical members are arranged in said chambers and each include first and second hemi-cylindrical portions for supporting said crosspiece and extending from opposite sides thereof in correspondence with said bridge base member recess and said rigid member extended portion recess, respectively, whereby selective rotation of said cylindrical members selectively positions said hemi-cylindrical portions for selective coupling of acoustic energy.

12. Apparatus as defined in claim 6, wherein said adjustable connecting devices each comprise a slide member, and further comprising a bridge base member connected with the soundboard.

13. Apparatus as defined in claim 12, wherein said adjustable connecting devices further comprise said height adjusting means, each of which includes (1) a first threaded vertical shaft fixed with and extending from said bridge base member;

(2) a second threaded vertical shaft fixed with and extending from said rigid member extended portion; and (3) thumbwheel means threadably connected with said first and second shafts, respectively, and vertically adjustable relative thereto, said slide means supporting said bridge saddle means and being selectively positioned to engage at least one of said thumbwheel means for selectively coupling acoustic energy from the strings to the soundboard and the rigid member via said slide member.

* * * * *